United States Patent [19]

Nettles et al.

[11] 4,142,661

[45] Mar. 6, 1979

[54] DIFFERENTIAL FLOW GUIDING AIR BEARING

[75] Inventors: Michael L. Nettles; Peter A. Stevenson, both of Boulder, Colo.

[73] Assignee: International Business Machines Corporation, Armonk, N.Y.

[21] Appl. No.: 835,254

[22] Filed: Sep. 21, 1977

[51] Int. Cl.[2] ..... B65H 17/32

[52] U.S. Cl. ..... 226/97; 271/195; 271/250

[58] Field of Search ..... 226/7, 97, 196, 198, 226/15; 271/195, 250

[56] References Cited

U.S. PATENT DOCUMENTS

| | | | |
|---|---|---|---|
| 3,213,204 | 10/1965 | Okamura | 179/100.2 |
| 3,268,222 | 8/1966 | Off | 226/196 X |
| 3,281,040 | 10/1966 | Grant | 226/196 X |
| 3,420,424 | 1/1969 | Barbeau | 226/196 X |
| 3,761,002 | 9/1973 | Baumann | 226/97 |
| 3,850,358 | 11/1974 | Nettles | 226/198 |
| 3,893,176 | 7/1975 | Jones | 360/70 |

OTHER PUBLICATIONS

IBM Technical Disclosure Bulletin, vol. 15, No. 9, Feb. 1973, D. W. Jones and K. Y. Wong, p. 2743.

IBM Technical Disclosure Bulletin, vol. 15, No. 9, Feb. 1973, D. W. Jones and A. M. Patlach, pp. 2744–2745.

IBM Technical Disclosure Bulletin, vol. 17, No. 4, Sep. 1974, R. C. Durbeck and D. W. Jones, p. 1188.

IBM Technical Disclosure Bulletin, vol. 18, No. 11, Apr. 1976, P. A. Stevenson, p. 3567.

IBM Technical Disclosure Bulletin, vol. 5, No. 4, Sep. 1962, Creating Transverse Curvature With Air Jets of Varying Sizes, R. V. Rogers, p. 21.

*Primary Examiner*—Richard A. Schacher

*Attorney, Agent, or Firm*—Earl C. Hancock

[57] ABSTRACT

Lateral force is applied to a web material by an air bearing for the purpose of guiding the web against a fixed reference edge. A bearing surface over which the web is movable includes an arrangement of holes for establishing a differential flow across the bearing surface to produce a lateral force on the web in the direction of the reference edge. The holes are arranged asymmetrically relative to the center line of the bearing surface but typically are parallel to the reference edge. The differential air flow is established by controlled sizes of apertures through the bearing plate, variable air permeability of the material forming the bearing surface or the like. A common source of pressurized air is coupled to all of the bearing surface holes.

10 Claims, 5 Drawing Figures

DIFFERENTIAL FLOW GUIDING AIR BEARING

BACKGROUND OF THE INVENTION

1. Field of the Invention

The present invention relates to apparatus for controlling the lateral positioning of elongated web material by means of fluidic medium flow between the web material and a bearing surface. More particularly, the present invention relates to apparatus for controlling the location of the edge of a movable elongated web material relative to a reference line through controlled pressurized gas introduction between the web material and a bearing surface. Although not necessarily limited thereto, the present invention is particularly useful for maintaining one side edge of a movable, elongated tape such as a magnetic tape against a reference edge as the tape is motivated lengthwise over an air bearing surface.

2. Description of the Prior Art

Various prior art devices use a fluidic medium and air in particular for supporting an elongated web material over a bearing surface. The problem of proper lateral positioning of this elongated web material over the bearing surface is particularly acute when the web material is a magnetic tape which must be guided over read/write heads for detecting magnetic indicia recorded on the tape. One prior art arrangement for providing the edge guiding result is to apply mechanical spring pressure to one side of the tape so as to direct the opposite side of the tape against a reference edge. U.S. Pat. No. 3,850,358 by Nettles shows an exemplary arrangement for this spring biased edge guiding. Yet another edge guiding arrangement known in the prior art employs jets for blowing pressurized air against one edge of the tape so as to literally push the other side of the tape against a reference edge.

Yet another approach in the prior art to the edge alignment problem is to employ differential air bearing flow beneath the tape so as to create a force unbalance and thus lateral movement of the tape against a reference edge. The prior art devices for effecting such a result have employed dual manifolds beneath a perforated bearing surface with separate pressure sources for each manifold and control systems to insure proper edge alignment. Examples of such dual manifold differential flow devices are shown in U.S. Pat. No. 3,893,176 by Jones and likewise in the IBM Technical Disclosure Bulletin articles entitled "Constant Fly Height, Constant Stiffness, Variable-Width Air Bearing" by Stevenson (Vol. 18, No. 11, April 1976, page 3567), "Tape Control Device" by Durbeck and Jones (Vol. 17, No. 4, September 1974, page 1188), "Steering Air Bearing With High-Speed Air Switching" by Jones and Wong (Vol. 15, No. 9, February 1973, page 2743) and "Tape Steering Device" by Jones and Patlach (Vol. 15, No. 9, February 1973, pages 2744–2745).

All of the prior art differential flow devices employ symmetrical hole patterns with dual manifolds or plenum chambers feeding separate sides of the aperture arrays and with the differential flow being established by controls of two separate pressure sources. FIG. 2 of the Jones and Patlach article entitled "Tape Steering Device" in the IBM Technical Disclosure Bulletin mentioned above employs a single pressure source and plenum chamber but further includes a positionable piston within the plenum chamber for controlled opening and closing of the bearing surface apertures so as to further control the lateral positioning of the web material as it passes over the bearing surface.

Although the aforementioned exemplary prior art is generally satisfactory in operation, practical implementations of these devices require acceptance of various disadvantages. For instance, the spring biased edge guiding creates additional loading on the edge of the magnetic tape and the differential flow devices using dual chambers requires multiple pressurized gas sources and relatively sophisticated controls for those sources.

SUMMARY OF THE INVENTION

The present invention is an apparatus for aligning a movable elongated web such as a magnetic tape or the like in a direction transverse to the length of that web. The device employs a single source of pressurized fluidic medium which is preferably air. An elongated plate member includes a bearing surface over which the web is movable and has a lip extending generally perpendicular to this bearing surface along one side for defining or establishing a reference edge for the side of the tape or web. The plate member has a plurality of openings therethrough which are coupled to the single source of pressurized fluidic medium with these openings being arranged for communicating the fluidic medium through the plate member. This establishes a differential flow of the medium between the bearing surface and the underside of the web with this differential flow imparting lateral or transverse forces to the web directed towards the reference establishing lip.

The openings through the surface bearing plate which establish the differential flow can take various forms in actual implementation. For instance, multiple arrays or lines of openings can be arranged on opposite sides of the center line of the bearing surface in a direction generally parallel to the reference edge established by the bearing surface lip. The differential flow can be established by arranging the arrays of openings asymmetrically relative to this center line or by using greater numbers of openings on the outboard side of the center line or both. Another alternative is to arrange the outboard holes larger than the inboard holes so as to establish greater flow rates therethrough. Still further, the bearing surface can be fabricated with gaseously permeable material arranged so that the outboard area passes a greater proportion of gas than the inboard material.

By use of the controlled gas flow through the bearing surface coupled to a single, common pressurized gas source, the potential mechanical interference of spring fingers and the sophistication of multiple manifold pressurized systems are avoided. The reference edge establishing structure and bearing surfaces in accordance with this invention can be adapted for curvilinear, helical, flat or any other configuration as long as adaptable to the web material being handled and the ultimate result intended. The reference edge establishing air bearing for elongated moving webs in accordance with the present invention can be fabricated at minimum expense but provides reliable and accurate web edge guiding in use.

The foregoing and other objects, features, advantages and applications of the present invention will be readily apparent to those having normal skill in the art from the following more particular description of the exemplary preferred embodiments as illustrated in the accompanying drawings.

DETAILED DESCRIPTION OF THE PREFERRED EMBODIMENTS

Figure 1:
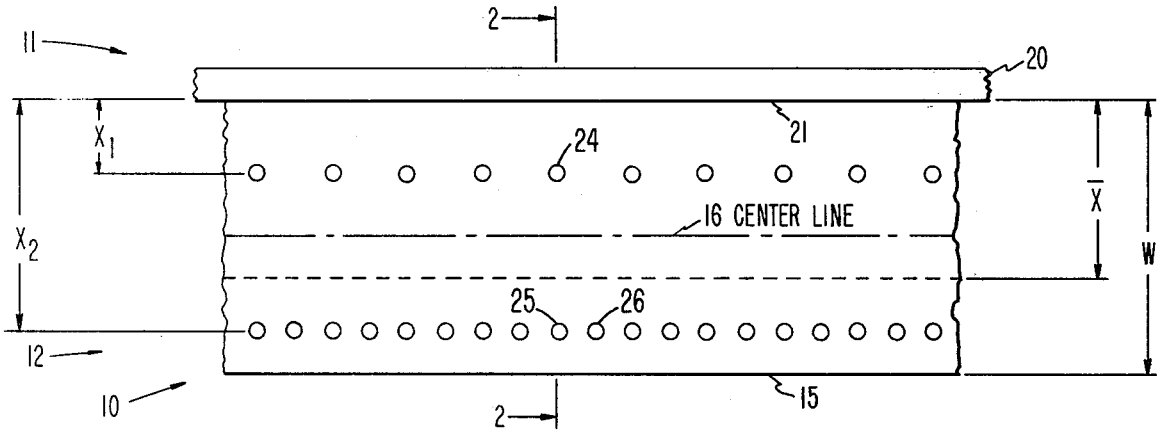
FIG. 1 is a top view of one embodiment of the present invention.
Figure 2:
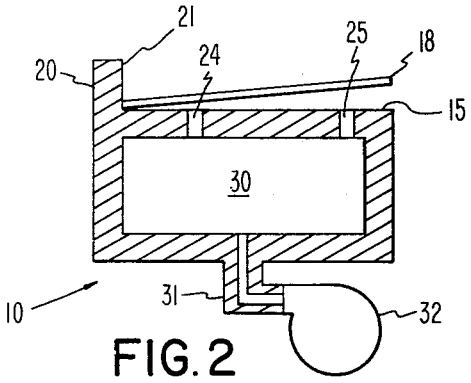
FIG. 2 is a section view taken along line 2—2 of FIG. 1.

A reference edge aligning air bearing guide 10 in accordance with this invention is illustrated in FIGS. 1 and 2. In this exemplary embodiments, two series of holes 11 and 12 through bearing surface 15 are arranged in an asymmetric hole pattern with respect to the bearing surface centerline 16 to generate a transverse axial force on elongated web 18 (not shown in FIG. 1). A rigid guide in the form of lip 20 is placed so that the inner edge 21 prevents axial displacement of tape 18, the axial force on tape 18 acting as a guiding force towards reference edge 21.

In addition to being spaced further outboard from centerline 16 than aperture row 11, aperture row 12 includes a greater number of openings than row 11. That is, for each opening of row 11 such as hole 24 there are two openings in row 12 such as 25 and 26. According pressurization of plenum chamber 30 from common air pump 32 via coupler 31 results in a differential flow guiding air bearing such that the flow strength moment ($\overline{X}$) is shifted outboard of the symmetrical bearing surface center line 16 in the direction away from the reference edge 21 as is shown in FIG. 1. This flow strength moment, $\overline{X}$, is defined respectively for discrete holes and for porous material (or equivalent) by the following equations:

$$\overline{X} = \sum_{i=1}^{n} \frac{(Xi) \times (Ai)}{\sum_{i=1}^{n} Ai} = \frac{\int_0^w xq(x)dx}{\int_0^w q(x)dx}$$

where Xi is the distance from the reference guiding edge 21 to the holes in the $i^{th}$ row, Ai is the hole area per unit length of the $i^{th}$ row and w is the width of the bearing surface as shown in FIG. 1.

The fluidic medium flow per unit area, g(x), is defined by the following equation:

$$q(x) = \int_0^x \left( \frac{\delta q}{\delta p} \frac{\delta p}{\delta x} + \frac{\delta q}{\delta k} \frac{\delta k}{\delta x} \right) dx$$

where p is the supply pressure and k is the flow conductivity per unit area. If the first center of moment of flow ($\overline{X}$) is more than W/2, ana axial or transverse force is produced from the fluidic medium flow causing displacement of the web 18 in the direction of the reference edge 21.

Note that the holes of array 11 can be equal in number with the holes of array 12 provided the asymmetric offset relative to center line 16 is observed. Alternatively, rows 11 and 12 can be arrayed symmetrically on either side of center line 16 provided row 12 has a greater number or size of openings than row 11.

Figure 3:
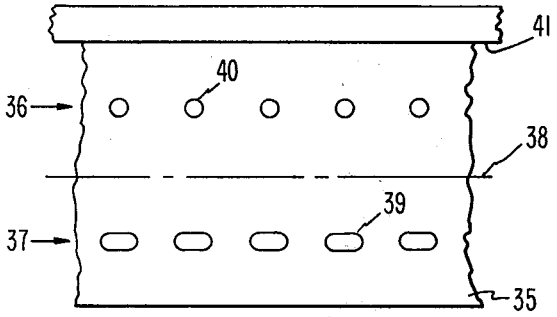
FIG. 3 is a top view of a bearing surface in accordance with another arrangement of this invention.

FIG. 3 shows an arrangement wherein bearing surface 35 has two arrays of holes 36 and 37 aligned symmetrically around center line 38. However, as shown in FIG. 3, each hole of array 37 such as port 39 is larger than its counterpart in array 36 such as port 40 and thus creates a greater flow rate from a common plenum source. Accordingly, the continously moving web over bearing surface 35 is directed against reference edge 41.

Figure 4:
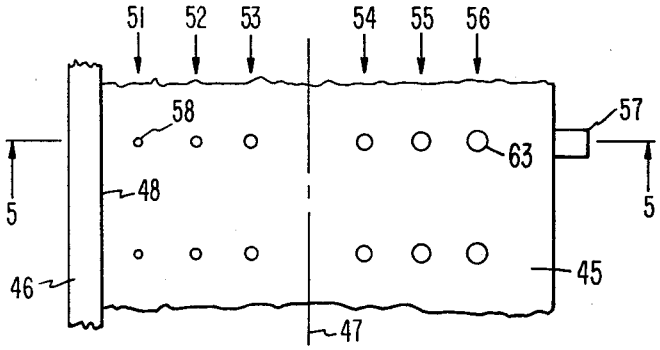
FIG. 4 is a top view of yet another implementation of the present invention.
Figure 5:
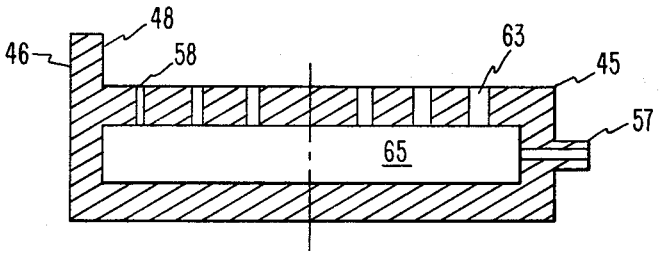
FIG. 5 is a section view taken along line 5—5 of FIG. 4.

Another example of an implementation of the present invention is shown in FIGS. 4 and 5 wherein FIG. 4 is a top view of an edge guiding bearing surface 45 and FIG. 5 is a section view taken along line 5—5 of FIG. 4. As with the previous embodiments, edge, lip 46 extends parallel to the center line 47 so as to define a reference edge 48 against which the web is to be aligned. In this particular example, rows of apertures 51–53 and 54–56 are arranged symmetrically on either side of center line 47. However, the apertures of arrays 51–56 are arranged so that they are progressively larger. That is, the holes of row 51 such as hole 58 are the smallest and the holes of each succeeding row become larger until the holes of outer row 56 such as hole 63 are the largest. All of these holes are coupled through nipple 57 to a common pressurized air source through manifold 65.

In a typical application, an edge guiding bearing in accordance with the present invention is placed on either side of a read/write head of a magnetic tape system so that the magnetic tape as it passes over the bearing surface will be precisely aligned against the established reference edge. The tape is normally in continuous movement in the direction of its length over the bearing surface and the air flow through the common source into the space between the tape and the bearing surface provides both spaced support for the tape and transverse reference edge guiding forces as discussed above. The invention has been shown for use in continuous web edge guiding and air bearing operations over a linear course but it can be incorporated into the mandrel guide in a helical scan type of a device. Thus it can be seen that skew control of the movable continuous elongated web is obtained with minimal cost of components.

Although not specifically illustrated, it will be recognized that the differential flow can be effected by a relatively porous material for forming the bearing surface with the porosity being controlled such that a greater air flow is obtained outboard of the physical center line than is transmitted through the area inboard of that center line. Although examples of variable hole size, variable hole spacing, variable porous materials with variable restrictivity per unit area and the like have been shown and/or discussed herein all for the purpose of producing a variable pressure across the bearing surface, various other modifications will be easily recognized. For instance, an additional control is available through manipulation of the pressure level from the commonly shared source which represents a factor in the magnitude of the differential air flow and thus the transverse guiding force imparted to the continuous web materials.

Although the present invention has been described with particularity relative to the foregoing detailed description of the exemplary preferred embodiments, various modifications, changes, additions and applications of the present invention in addition to those mentioned herein will be readily apparent to those having normal skill in the art without departing from the spirit of this invention.

What is claimed is:

1. Apparatus for aligning a movable elongated web in a direction transverse to its length while concurrently providing air bearing support for the web comprising:

a source of pressurized fluidic medium, and an elongated plate member including a bearing surface over which the web is movable and a lip portion extending generally perpendicular above said bearing surface along one side thereof for defining a reference edge for the web, said plate member further including a plurality of openings therethrough commonly coupled to said source with said openings being arranged for communicating said fluidic medium through said plate member in a direction substantially normal to said bearing surface for establishing a differential flow of said medium between said surface and the web with said differential flow imparting force to the web towards said lip portion.

2. Apparatus in accordance with claim 1 wherein said plurality of fluidic medium communicating openings are arranged in first and second arrays through said plate member, said first opening array being arranged along said plate surface between said lip portion and the center line of said surface wherein said center line is parallel to said lip portion, said second opening array being arranged along said plate surface between said center line and the side of said surface opposite said lip portion.

3. Apparatus in accordance with claim 2 wherein said second opening array is closer to said center line than said first opening array.

4. Apparatus in accordance with claim 2 wherein said second opening array is configured for communicating a greater flow of said fluidic medium therethrough than said first opening array.

5. Apparatus in accordance with claim 4 wherein said first and second opening arrays each include a series of ports parallel to said lip portion reference edge with said first and second port series being along lines approximately equidistant from said surface center line.

6. Apparatus in accordance with claim 5 wherein said ports of said second series are larger than said ports of said first series.

7. Apparatus in accordance with claim 6 wherein said ports of said second series are greater in number than said ports of said first series.

8. Apparatus for edge aligning a movable elongated web while concurrently providing air bearing support for the web comprising:

a source of pressurized gas, an elongated plenum chamber coupled for receiving pressurized gas from said source, and an elongated plate having a bearing surface on one side over which the web is movable and lip portion extending generally perpendicular to said bearing surface along one edge thereof for defining a reference edge for the web, said plate having a plurality of openings oriented substantially perpendicularly therethrough along the length thereof with said openings receiving pressurized gas from said plenum chamber, said openings being arranged for introducing pressurized gas between said bearing surface and the web for establishing a continuous differential flow of the gas for imparting force to the web towards said lip portion.

9. Apparatus in accordance with claim 8 wherein said plurality of openings are arranged in first and second elongated arrays on opposite sides of a center line on said bearing surface between said reference edge and the opposite edge of said surface.

10. Apparatus in accordance with claim 9 wherein said first and second elongated arrays of openings are generally symmetrical relative to said bearing surface center line with said elongated array of openings closest to said bearing surface edge opposite said lip portion edge being configured for introducing a greater flow of gas between said bearing surface and the web than the other said elongated array of openings.

* * * * *